US005176840A

United States Patent [19]

Campbell et al.

[11] Patent Number: 5,176,840

[45] Date of Patent: Jan. 5, 1993

[54] GEAR OIL ADDITIVE COMPOSITION AND GEAR OIL CONTAINING THE SAME

[75] Inventors: Donald G. Campbell, St. Louis; Stephen Norman, Florissant; Gergory S. Conary, St. Louis, all of Mo.

[73] Assignee: Ethyl Petroleum Additives, Inc., Richmond, Va.

[21] Appl. No.: 480,904

[22] Filed: Feb. 16, 1990

[51] Int. Cl.[5] ..... C10M 141/06

[52] U.S. Cl. ..... 252/49.6; 252/51.5 A

[58] Field of Search ..... 252/49.6, 51.5 A

[56] References Cited

U.S. PATENT DOCUMENTS

| | | | |
|---|---|---|---|
| 3,219,666 | 11/1965 | Norman et al. | 252/51.5 A |
| 3,254,025 | 5/1966 | Le Suer | 252/49.6 |
| 4,234,435 | 11/1980 | Meinhardt et al. | 252/51.5 A |
| 4,374,033 | 2/1983 | Malec | 252/49.6 |
| 5,021,176 | 6/1991 | Bullen et al. | 252/51.5 A |

*Primary Examiner*—Jacqueline Howard
*Attorney, Agent, or Firm*—John F. Sieberth

[57] ABSTRACT

Gear oil additive concentrates and lubricant compositions containing a combination of additives which minimize noise and vibration that occasionally develop in limited slip axles. The additive combinations include (i) an oil-soluble succinimide of the formula

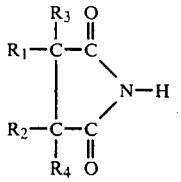

wherein $R_1$ is alkyl or alkenyl having 8 to 50 carbon atoms, and $R_2$, $R_3$ and $R_4$ are hydrogen atoms or alkyl or alkenyl groups having up to about 4 carbon atoms; and (ii) a boronated or non-boronated carboxylic derivative composition produced by reacting a substituted succinic acylating agent with (a) amine having at least one primary or secondary amino group in the molecule, or (b) at least one alcohol, or (c) a combination of (a) and (b). The substituent of the succinic acylating agent is derived from polyalkene having a number average molecular weight of about 500 to about 100,000. The additive concentrates and lubricant compositions are devoidd of any metal-containing component.

45 Claims, No Drawings

GEAR OIL ADDITIVE COMPOSITION AND GEAR OIL CONTAINING THE SAME

TECHNICAL FIELD

This invention relates to additive compositions adapted for use in manual transmission oils and in gear oils, and especially in rear axle lubricants to minimize noise and vibration that occasionally develop in limited slip axles. This invention also relates to manual transmission and gear oils containing such additive compositions.

BACKGROUND

Although a substantial number of gear oil additive concentrates are available in the marketplace, there exists a need for an additive to provide limited slip or enhanced positraction performance in a wide range of mineral and synthetic base gear oils. A most welcome contribution to the art would be the provision of an additive composition enabling present-day gear oil formulations to exhibit improved positraction performance in the GM limited slip axle chatter test (R-4A1-4), commonly referred to as the "big wheel, little wheel test".

Inasmuch as gear oils and manual transmission oils (collectively referred to hereinafter in the specification and in the claims as "gear oils") are subjected to prolonged usage in differentials and like devices, it is also important to prevent sludge deposition on critical mechanical surfaces.

THE INVENTION

This invention provides additive compositions and gear oils capable of suppressing noise and vibration tending to occur in limited slip axles. Additionally, this invention prevents or at least greatly inhibits, the deposition of sludge on critical surfaces of differentials and like mechanical apparatus.

In one of its embodiments this invention provides a gear oil additive composition comprising:

(i) at least one oil-soluble succinimide of the formula

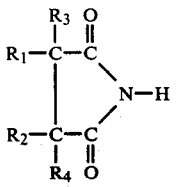

wherein $R_1$ is an alkyl or alkenyl group having an average of 8 to 50 carbon atoms (preferably 14–30 carbon atoms), and each of $R_2$, $R_3$ and $R_4$ is, independently, a hydrogen atom or an alkyl or alkenyl group having an average of up to about 4 carbon atoms; and (ii) at least one carboxylic derivative composition produced by reacting at least one substituted succinic acylating agent with a reactant selected from the group consisting of (a) amine having at least one primary or secondary amino group in the molecule, (b) at least one alcohol, and (c) a combination of (a) and (b), the components of (c) being reacted with such substituted succinic acylating agent(s) simultaneously or sequentially in any order, wherein such substituted succinic acylating agent(s) has/have a substituent group derived from polyalkene having a number average molecular weight of about 500 to about 100,000;

said gear oil additive composition being devoid of any metal-containing additive component. For the purposes of this invention, boron is not considered a metal. Thus in the practice of this invention, component (ii) can be a boron-containing carboxylic derivative of the type described.

Accordingly, another embodiment of this invention provides a gear oil additive composition comprising:

(i) at least one oil-soluble succinimide of the formula

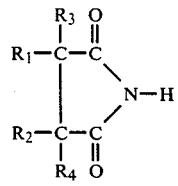

wherein $R_1$ is an alkyl or alkenyl group having an average of 8 to 50 carbon atoms, and each of $R_2$, $R_3$ and $R_4$ is, independently, a hydrogen atom or an alkyl or alkenyl group having an average of up to about 4 carbon atoms; and (ii) at least one boronated carboxylic derivative composition produced by reacting at least one substituted succinic acylating agent with a reactant selected from the group consisting of (a) amine having at least one primary or secondary amino group in the molecule, (b) at least one alcohol, and (c) a combination of (a) and (b), the components of (c) being reacted with such substituted succinic acylating agent(s) simultaneously or sequentially in any order, and reacting the resultant product with a boron compound to form said boronated carboxylic derivative composition, such substituted succinic acylating agent(s) having a substituent group derived from polyalkene having a number average molecular weight of about 500 to about 100,000;

said gear oil additive composition being devoid of any metal-containing additive component.

Heretofore, crankcase lubricating oil additive concentrates have been produced containing, inter alia, components (i) and (ii) together with metal-containing additive components. Such additive concentrates and resulting crankcase lubricant compositions are unsuitable for use in the practice of this invention.

The proportions of (i):(ii) on a weight basis may range from 5:1 to 1:5, preferably 2.5:1 to 1:2.5, and more preferably 1:1 to 1.2:1. In the above embodiments it is particularly preferred to include another component, namely: (iii) solvent oil whereby the proportions of components (i), (ii) and (iii) and the total of components (i) and (ii) in the additive composition (all in weight percentages) are as follows:

| Component | Preferred Range | More Preferred Range | Most Preferred Range |
|---|---|---|---|
| (i) | 10–80 | 10–50 | 10–35 |
| (ii) | 10–80 | 10–50 | 10–35 |
| (i) + (ii) | 20–90 | 30–60 | 40–45 |
| (iii) | 10–80 | 40–70 | 55–60 |

Another embodiment of this invention is a gear oil composition comprising a major amount of a gear oil base stock containing a sulfur additive complement, a phosphorus additive complement, and a nitrogen additive complement, in proportions such that the composition possesses a weight ratio of sulfur to phosphorus in the range of about 5:1 to about 40:1 and a weight ratio of nitrogen to phosphorus in the range of about 0.05:1 to about 2:1, said base oil additionally containing a minor effective amount of:

(i) at least one oil-soluble succinimide of the formula

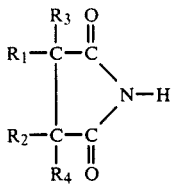

wherein $R_1$ is an alkyl or alkenyl group having an average of 8 to 50 carbon atoms (preferably 14–30 carbon atoms), and each of $R_2$, $R_3$ and $R_4$ is independently, a hydrogen atom or an alkyl or alkenyl group having an average of up to about 4 carbon atoms; and (ii) at least one carboxylic derivative composition produced by reacting at least one substituted succinic acylating agent with a reactant selected from the group consisting of (a) amine having at least one primary or secondary amino group in the molecule (b) at least one alcohol, and (c) a combination of (a) and (b) the components of (c) being reacted with such substituted succinic acylating agent(s) simultaneously or sequentially in any order, wherein such substituted succinic acylating agent(s) has/have a substituent group derived from polyalkene having a number average molecular weight of about 500 to about 100,000:

said gear oil composition being devoid of any metal-containing additive component. The oil as it is used may, of course, contain metal which, during service, accumulates in the oil because of friction, wear or corrosion of metal parts.

In still other embodiments of this invention, component (ii) in the lubricating oil composition is a boronated carboxylic derivative composition such as a boronated succinimide or boronated succinic acid ester.

Preferred products for use as component (ii) are those formed by reacting the acylating agent with an amine having at least two primary amino groups in the molecule.

Other embodiments and features of this invention will be apparent from the ensuing description and appended claims.

COMPONENT (i)

Compounds of this type are known in the art. For example European Patent Publication No. 20037, published Dec. 10, 1980, describes their use as friction reducing additives in crankcase lubricating oils and in gasoline and diesel fuel. See also British Patent No. 1,111,837 published May 1, 1968 which suggests their use as ashless dispersants for engine oils and as rust inhibitors in a variety of lubricating oils, including engine oils. The disclosures of these two documents are incorporated herein by reference. The synthesis method described in the European patent publication is deemed superior to that described in the British patent.

As noted above, component (i) can be a single compound or a mixture of two or more compounds of the formula

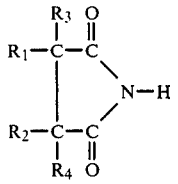

where $R_1$ is an alkyl or alkenyl or polyunsaturated group having an average of 8 to 50, preferably an average of 14 to 30, and most preferably an average of 20 to 24 carbon atoms and each of $R_2$, $R_3$ and $R_4$ is independently, a hydrogen atom or an alkyl or alkenyl group having an average of up to about 4 carbon atoms. Most preferably each of $R_2$, $R_3$ and $R_4$ is a hydrogen atom. In the most preferred compounds $R_1$ is derived from an isomerized 1-olefin and thus is composed predominantly of at least one group (usually a plurality of groups) represented by the formula $R_5R_6CH$— wherein $R_5$ and $R_6$ are independently alkyl or alkenyl groups, which most preferably are linear or substantially linear. The total number of carbon atoms in $R_5$ and $R_6$ is of course one less than the number of carbon atoms in that particular $R_1$.

Illustrative examples of these compounds are given below. In these examples (1) the numerals 3 and 4 designate the position(s) of the substituent(s) o the succinimide ring; (2) the secondary alkenyl substituents represent the predominant alkenyl groups formed when producing the compounds from the corresponding isomerized (predominantly internal) linear olefins by a process such as described in the above-referred to European patent publication; and (3) the secondary alkyl substituents represent the alkyl groups resulting from hydrogenolysis of the secondary alkenyl substituents:

3-octenylsuccinimide
3-octenyl-4-methylsuccinimide
3-octenyl-4,4-dimethylsuccinimide
3-octenyl-4-ethylsuccinimide
3-octenyl-4-ethyl-4-methylsuccinimide
3-octenyl-4-butylsuccinimide
3-octenyl-4-vinylsuccinimide
3-octenyl-4-allylsuccinimide
3-octenyl-4-butenylsuccinimide
3-sec-octenylsuccinimide
3-sec-octenyl-4-isopropylsuccinimide
3-octylsuccinimide
3-octyl-4-methylsuccinimide
3-sec-octylsuccinimide
3-sec-octyl-4-methylsuccinimide
3-sec-octyl-4-ethylsuccinimide
3-sec-octyl-4-propylsuccinimide
3-sec-octyl-4,4-dimethylsuccinimide
3-sec-octyl-4,4-diethylsuccinimide, and the like and each of the corresponding compounds containing 9 through 50 carbon atoms in the alkyl or alkenyl substituent in the 3-position. Mixtures of two or more of any such compounds can also be used.

An especially preferred succinimide for use as component (i) is predominantly a mixture of $C_{20}$, $C_{22}$ and $C_{24}$ sec-alkenylsuccinimides made from an isomerized 1-olefin mixture containing (wt %):

$C_{18}$: max. 3

$C_{20}$: 45–55
$C_{22}$: 31–47
$C_{24}$: 4–15
$C_{26}$: max. 1

COMPONENT (ii)

The carboxylic derivative compositions used in the practice of this invention are produced by reacting at least one substituted succinic acylating agent with (a) amine having at least one primary or secondary amino group in the molecule, (b) alcohol, (c) a combination of (a) and (b), the components of (c) being reacted with such substituted succinic acylating agent(s) simultaneously or sequentially in any order. The substituted succinic acylating agent contains a substituent group derived from polyalkene, the substituent having an $\overline{M}n$ value of about 500 to about 10,000, preferably in the range of about 750 to about 5,000.

For the purposes of this invention, the $\overline{M}n$ value for the polyalkene used in forming the substituted succinic acylating agent is determined by gel permeation chromatography in the manner described in U.S. Pat. No. 4,234,435 from Column 7, line 7 through Column 8, line 31, which description is expressly incorporated herein by reference.

Thus, the substituted succinic acylating agents are those which can be characterized by the presence within their structure of two groups or moieties. The first group or moiety is a substituent group derived from a polyalkene. The polyalkene from which the substituted groups are derived is characterized by an $\overline{M}n$ (number average molecular weight) value of from about 500 to about 10,000, and preferably in the range of from about 750 to about 5,000.

The second group or moiety is the succinic group, a group characterized by the structure

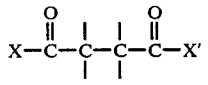

Formula I wherein X and X' are the same or different provided at least one of X and X' is such that the substituted succinic acylating agent can function as a carboxylic acylating agent. In other words, at least one of X and X' must be such that the substituted acylating agent can esterify alcohols, form amides or amine salts with ammonia or amines, form metal salts with reactive metals or basically reacting metal compounds, and otherwise functions as a conventional carboxylic acid acylating agent. Transesterification and transamidation reactions are considered, for purposes of this invention, as conventional acylation reactions.

Thus, X and/or X' is usually —OH, —O—hydrocarbyl; $—O^-M^+$ where $M^+$ represents one equivalent of a metal, ammonium or amine cation, $—NH_2$, —Cl, —Br, and together, X and X' can be —O— so as to form the anhydride. The specific identify of any X or X' group which is not one of the above is not critical so long as its presence does not prevent the remaining group from entering into acylation reactions. Preferably, however, X and X' are each such that both carboxyl functions of the succinic group can enter into acylation reactions.

One of the unsatisfied valences in the grouping

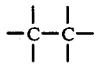

of Formula I forms a carbon-to-carbon bond with a carbon atom in the substituent group. While other such unsatisfied valence may be satisfied by a similar bond with the same or different substituent group, all but the said one such valence is usually satisfied by a hydrogen atom.

The succinic groups of the succinic acylating agents will normally correspond to the formula

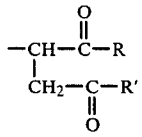

Formula II wherein R and R' are each independently selected from the group consisting of —OH, —Cl, —OR'' (R''=lower alkyl), and when taken together, R and R' are —O—. In the latter case the succinic group is a succinic anhydride group. All the succinic groups in a particular succinic acylating agent need not be the same, but they can be the same. Preferably, the succinic groups will correspond to

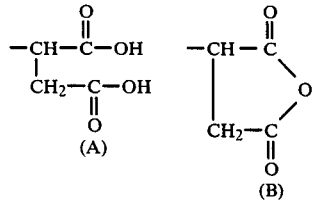

Formula III and mixtures of III(A) and III(B). Production of substituted succinic acylating agents wherein the succinic groups are the same or different is within ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

The polyalkenes from which the substituent groups are derived are homopolymers and interpolymers of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, the polymers used include binary copolymers, terpolymers, tetrapolymers, and the like. The polyalkenes from which the substituent groups are derived are often referred to as polyolefin(s).

The olefin monomers from which the polyalkenes are derived are polymerizable olefin monomers characterized by the presence of one or more ethylenically unsaturated groups (i.e., >C=C<); that is, they are monoolefinic monomers such as ethylene, propylene, 1-butene, isobutene, and 1-octene or polyolefinic monomers (usually diolefinic monomers) such as 1,3-butadiene and isoprene.

These olefin monomers are usually polymerizable terminal olefins; that is, olefins characterized by the presence in their structure of the group $>C{=}CH_2$. However, polymerizable internal olefin monomers characterized by the presence within their structure of the group

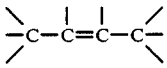

can also be used to form the polyalkenes. When internal olefin monomers are employed, they normally will be employed with terminal olefins to produce polyalkenes which are interpolymers. When a particular polymerizable olefin monomer can be classified as both a terminal olefin and an internal olefin, it is usually categorized as a terminal olefin. An example of such a monomer is 1,3-pentadiene (i.e., piperylene).

While the polyalkenes from which the substituent groups of the succinic acylating agents are derived generally are hydrocarbon polyalkenes, they can contain non-hydrocarbon groups such as lower alkoxy, lower alkyl mercapto, hydroxy, mercapto, oxo, nitro, halo, cyano, carboalkoxy (i.e.,

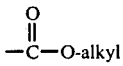

where "alkyl" is usually lower alkyl, namely an alkyl group containing up to about 7 carbon atoms), alkanoyloxy (or carbalkoxy, i.e.,

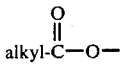

where "alkyl" is usually lower alkyl), and the like, provided the non-hydrocarbon substituents do not substantially interfere with formation of the substituted succinic acid acylating agents. When present, such non-hydrocarbon groups normally will not contribute more than about 10% by weight of the total weight of the polyalkenes. Since the polyalkene can contain such non-hydrocarbon substituents, it is apparent that the olefin monomers from which the polyalkenes are made can also contain such substituents. Normally, however, as a matter of practicality and expense, the olefin monomers and the polyalkenes used are free from non-hydrocarbon groups, except chloro groups which usually facilitate the formation of the substituted succinic acylating agents.

Although the polyalkenes may include aromatic groups (especially phenyl groups and lower alkyl- and/or lower alkoxy-substituted phenyl groups such as p-tert-butylphenyl and cycloaliphatic groups such as would be obtained from polymerizable cyclic olefins or cycloaliphatic substituted-polymerizable acyclic olefins, the polyalkenes usually will be free from such groups. Nevertheless, polyalkenes derived from interpolymers of both 1,3-dienes and styrenes such as 1,3-butadiene and styrene or 4-tert-butyl-styrene are exceptions to this generalization. Similarly, the olefin monomers from which the polyalkenes are prepared can contain both aromatic and cycloaliphatic groups.

Generally speaking aliphatic hydrocarbon polyalkenes free from aromatic and cycloaliphatic groups are preferred for use in preparing the substituted succinic acylating agents. Particularly preferred are polyalkenes which are derived from homopolymers and interpolymers of terminal hydrocarbon olefins of 2 to about 8 carbon atoms, most especially from 2 to 4 carbon atoms. While interpolymers of terminal olefins are usually preferred, interpolymers optionally containing up to about 40% of polymer units derived from internal olefins of up to about 8 carbon atoms are also preferred. The most preferred polyalkenes are polypropylenes and polyisobutenes.

Specific examples of terminal and internal olefin monomers which can be used to prepare the polyalkenes according to conventional, well-known polymerization techniques include ethylene; propylene; 1-butene; 2-butene; isobutene; 1-pentene; 1-hexene; 1-heptene, 2-butene; isobutene; 2-pentene, 1-hexene; 1-heptene; 1-octene: 1-nonene; 1-decene; 2-pentene; propylenetetramer; diisobutylene: isobutylene trimer; 1,2-butadiene; 1,3-butadiene: 1,2-pentadiene; 1,3-pentadiene; 1,4-pentadiene: isoprene; 1,5-hexadiene; 2-chloro-1,3-butadiene: 2-methyl-1-heptene; 4-cyclohexyl-1-butene; 3-pentene; 4-octene; 3,3-dimethyl-1-pentene; styrene; 2,4-dichlorostyrene; divinylbenzene; vinyl acetate; allyl alcohol; 1-methyl-vinyl acetate; acrylonitrile; ethyl acrylate; methyl methacrylate; ethyl vinyl ether; and methyl vinyl ketone. Of these, the hydrocarbon polymerizable monomers are preferred and of these hydrocarbon monomers, the terminal olefin monomers are particularly preferred.

Specific examples of polyalkenes include polypropylenes, polybutenes, ethylene-propylene copolymers, styrene-isobutene copolymers, isobutene-1,3-butadiene copolymers, propene-isoprene copolymers, isobutene-chloroprene copolymers, isobutene-4-methylstyrene copolymers, copolymers of 1-hexene with 1,3-hexadiene, copolymers of 1-octene with 1-hexene, copolymers of 1-heptene with 1-pentene, copolymers of 3-methyl-1-butene with 1-octene, copolymers of 3,3-dimethyl-1-pentene with 1-hexene, and terpolymers of isobutene, styrene and piperylene. More specific examples of such interpolymers include copolymer of 95% (by weight) of isobutene with 5% (by weight) of styrene; terpolymer of 98% of isobutene with 1% of piperylene and 1% of chloroprene; terpolymer of 95% of isobutene with 2% of butene 1 and 3% of 1-hexene; terpolymer of 60% of isobutene with 20% of 1-pentene and 20% of 1-octene; copolymer of 80% of 1-hexene and 20% of 1-heptene; terpolymer of 90% of isobutene with 2% of cyclohexene and 8% of propylene; and copolymer of 80% of ethylene and 20% of propylene. A preferred source of polyalkenes are the polyisobutenes obtained by polymerization of $C_4$ refinery stream having a butene content of about 35 to about 75 percent by weight and an isobutene content of about 30 to about 60 percent by weight using a Lewis acid catalyst such as aluminum trichloride or boron trifluoride. These polybutenes contain predominantly (greater than about 80% of the total repeating units) of repeating units of the configuration

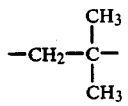

In preparing polyalkenes, conventional techniques known to those skilled in the art include suitably controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

In preparing the substituted succinic acylating agents, one or more of the above-described polyalkenes is reacted with one or more maleic or fumaric acidic reactants of the general formula

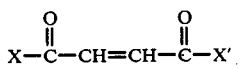

Formula IV wherein X and X' are as defined hereinbefore. Preferably the maleic and fumaric reactants will be one or more compounds corresponding to the formula

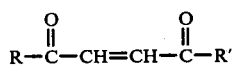

Formula V wherein R and R' are as previously defined herein. Ordinarily the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acylating agents. The most preferred reactants are maleic acid, maleic anhydride, and mixtures of these.

Any of a variety of known procedures can be used to produce the substituted succinic acylating agents. For convenience and brevity, when the term "maleic reactant" is used hereafter, the term is generic to the reactants corresponding to Formulas IV and V above including mixtures of such reactants.

One procedure for preparing the substituted succinic acylating agents is illustrated, in part, by the two-step procedure described in U.S. Pat. No. 3,219,666. It involves first chlorinating the polyalkene until there is an average of at least about one chloro group for each molecular weight (i.e., each $\overline{M}n$) of polyalkene. Chlorination involves merely contacting the polyalkene with chlorine gas until the desired amount of chlorine is incorporated into the chlorinated polyalkene. Chlorination is generally carried out at a temperature of about 75° C. to about 125° C. If desired, a diluent can be used in the chlorination procedure. Suitable diluents for this purpose include poly- and perchlorinated and/or fluorinated alkanes and benzenes.

The second step in the two-step chlorination procedure is to react the chlorinated polyalkene with the maleic reactant at a temperature usually within the range of about 100° C. to about 200° C. The mole ratio of chlorinated polyalkene to maleic reactant is usually about 1:1. In this connection, a mole of chlorinated polyalkene may be regarded as the weight of chlorinated polyalkene corresponding to the $\overline{M}n$ value of the unchlorinated polyalkene. However, a stoichiometric excess of maleic reactant can be used, for example, a mole ratio of 1:2. If an average of more than about one chloro group per molecule of polyalkene is introduced during the chlorination step, then more than one mole of maleic reactant can react per molecule of chlorinated polyalkene. Accordingly, the ratio of chlorinated polyalkene to maleic reactant may be referred to in terms of equivalents, an equivalent weight of chlorinated polyalkene being the weight corresponding to the $\overline{M}n$ value divided by the average number of chloro groups per molecule of chlorinated polyalkene. The equivalent weight of a maleic reactant is its molecular weight. Thus, the ratio of chlorinated polyalkene to maleic reactant will normally be such as to provided about one equivalent of maleic reactant for each mole of chlorinated polyalkene up to about one equivalent of maleic reactant for each equivalent of chlorinated polyalkene with the understanding that it is normally desirable to provide an excess of maleic reactant; for example, an excess of about 5% to about 25% by weight. Unreacted excess maleic reactant may be stripped from the reaction product, usually under vacuum, or reacted during a further stage of the process as explained below.

The resulting polyalkenyl-substituted succinic acylating agent is, optionally, again chlorinated if the desired number of succinic groups are not present in the product. If there is present, at the time of this subsequent chlorination, any excess maleic reactant from the second step, the excess will react as additional chlorine is introduced during the subsequent chlorination. Otherwise, additional maleic reactant is introduced during and/or subsequent to the additional chlorination step. This technique can be repeated until the total number of succinic groups per equivalent weight of substituent groups reaches the desired level.

Another procedure for preparing substituted succinic acid acylating agents utilizes a process described in U.S. Pat. No. 3,912,764 and U.K. Pat. No. 1,440,219. According to that process, the polyalkene and the maleic reactant are first reacted by heating them together in a direct alkylation procedure. When the direct alkylation step is completed, chlorine is introduced into the reaction mixture to promote reaction of the remaining unreacted maleic reactants. According to the patents, 0.3 to 2 or more moles of maleic anhydride are used in the reaction for each mole of olefin polymer; i.e., polyalkene. The direct alkylation step is conducted at temperatures of 180° C. to 250° C. During the chlorine-introducing stage, a temperature of 160° C. to 225° C. is employed.

Other known processes for preparing the substituted succinic acylating agents include the one-step process described in U.S. Pat. Nos. 3,215,707 and 3,231,587. Basically, this process involves preparing a mixture of the polyalkene and the maleic reactant in suitable proportions and introducing chlorine into the mixture, usually by passing chlorine gas through the mixture with agitation, while maintaining a temperature of at least about 140° C.

Usually, where the polyalkene is sufficiently fluid at 140° C. and above, there is no need to utilize an additional substantially inert, normally liquid solvent/diluent in the one-step process. However, if a solvent/diluent is employed, it is preferably one that resists chlorination such as the poly- and perchlorinated and/or -fluorinated alkanes, cycloalkanes, and benzenes.

Chlorine may be introduced continuously or intermittently during the one-step process. The rate of introduction of the chlorine is not critical although, for maximum utilization of the chlorine, the rate should be about the same as the rate of consumption of chlorine in the course of the reaction. When the introduction rate of chlorine exceeds the rate of consumption, chlorine is evolved from the reaction mixture. It is often advantageous to use a closed system, including superatmospheric pressure, in order to prevent loss of chlorine so as to maximize chlorine utilization.

The minimum temperature at which the reaction in the one-step process takes place at a reasonable rate is about 140° C. Thus, the minimum temperature at which the process is normally carried out is in the neighborhood of 140° C. The preferred temperature range is usually between about 160° C. and about 220° C. Higher temperatures such as 250° C. or even higher may be used but usually with little advantage. In fact, excessively high temperatures may be disadvantageous because of the possibility that thermal degradation of either or both of the reactants may occur at excessively high temperatures.

In the one-step process, the molar ratio of maleic reactant to chlorine is such that there is at least about one mole of chlorine for each mole of maleic reactant to be incorporated into the product. Moreover, for practical reasons, a slight excess, usually in the neighborhood of about 5% to about 30% by weight of chlorine, is utilized in order to offset any loss of chlorine from the reaction mixture. Larger amounts of excess chlorine may be used.

Further details concerning procedures for producing the substituted acylating agents have been extensively described in the patent literature, such as for example in U.S. Pat. No. 4,234,435, all disclosure of which is incorporated herein, and thus further amplification of such procedures herein is deemed unnecessary.

As noted above, the substituted acylating agents are reacted with (a) amine having at least one primary or secondary amino group in the molecule, or (b) alcohol, or (c) a combination of (a) and (b), the components of (c) being reacted with the acylating reagents simultaneously or sequentially in any order.

The amine, reactant (a) above, can be a monoamine or polyamine, including hydrazine and substituted hydrazines. Such reactants can be used either singly or in various mixtures. Use of polyamines having at least two primary amino groups in the molecule are generally preferred. Alkylene polyamines having both primary and secondary amino groups in the molecule are particularly preferred, especially where the alkylene polyamines contain at least two primary amino groups and one or more secondary amino groups.

Alcohols, reactant (b) above, which can be used include the monohydric and polyhydric alcohols. The polyhydric alcohols are preferred.

Numerous examples of reactants (a) and (b) are set forth in U.S. Pat No. 4,234,435 to which reference may be had for this purpose, and which disclosure is incorporated herein in toto.

Of the various succinic derivatives which may be used in the practice of this invention, those formed by reaction between an alkenyl succinic acid or alkenyl succinic anhydride and an amine having at least two primary amino groups in the molecule are preferred. Products of this type made from an alkylene polyamine or mixture of alkylene polyamines are particularly preferred, as are the corresponding boronated succinimide products. Such polyamines may be represented by the formula $$H_2N(CH_2)_n(NH(CH_2)_n)_mNH_2$$

wherein n is in the range of 2 to about 10 (preferably 2 to 3 and most preferably 2) and m is in the range of 0 to 10, (preferably 0 to about 6). Illustrative are ethylene diamine, diethylene triamine, triethylene tetramine, tetraethylene pentamine, pentaethylene hexamine, propylene diamine (1,3-propanediamine), butylene diamine (1,4-butanediamine), hexamethylene diamine (1,6-hexanediamine), decamethylene diamine (1,10-decanediamine), and the like. Particularly preferred for use is tetraethylene pentamine or a mixture of ethylene polyamines which approximates tetraethylene pentamine such as "DOW E-100" (a commercial mixture available from Dow Chemical Company, Midland, Mich.).

When preparing the boronated succinimides and boronated succinic esters, a succinimide or succinic ester (or mixture thereof) is reacted with one or more boron-containing reactants such as boron halides, boron acids, and esters of boron acids. Boric acid is commonly used for this purpose. The procedures employed in producing boronated succinimides and boronated succinic esters are well documented in the patent literature.

As those skilled in the art can appreciate, various succinimides, succinic esters, boronated succinimides, and boronated succinic esters are available as articles of commerce.

An especially preferred product for use as component (ii) is a polyisobutenyl succinimide made from polyisobutenylsuccinic anhydride in which the polyisobutenyl substituent is derived from polyisobutene with a number average molecular weight of approximately 1300 and a mixture of polyethylene polyamines approximating tetraethylene pentamine in average overall composition, such product dissolved in 100 solvent neutral oil and having a viscosity at 100° C. in the range of 350–550 centistokes and a specific gravity (ASTM D1298) at 15.6° C. (60° F.) in the range of 0.945 to 0.965. Another especially preferred product for use as component (ii) is a boronated polyisobutenyl succinimide of the type just described which has been further reacted with a boron compound, most preferably boric acid, to effect boronation of the polyisobutenyl succinimide.

COMPONENT (iii)

The oleaginous diluent which is preferably employed in the gear oil additives of this invention can be derived from natural or synthetic sources. Among the mineral (hydrocarbonaceous) oils are paraffin base, naphthenic base, asphaltic base and mixed base oils. Typical synthetic base oils include polyolefin oils (especially hydrogenated α-olefin oligomers), alkylated aromatics, polyalkylene oxides, aromatic ethers, and carboxylate esters (especially diester oils), among others. Blends of natural and synthetic oils can also be used. The preferred diluents are the light hydrocarbon base oils, both natural or synthetic. Generally the diluent oil will have a viscosity in the range of 13 to 35 centistokes at 40° C., and preferably in the range of 18.5 to 21.5 centistokes at 40° C. A 100 neutral mineral oil with a viscosity of about 19 centistokes at 40° C. with a specific gravity (ASTM D1298) in the range of 0.855 or 0.893 (most preferably about 0.879) at 15.6° C. (60° F.) and an ASTM color (D1500) of 2 maximum is particularly preferred for this use.

GEAR OIL BASE STOCKS

The gear oils in which the compositions of this invention are employed can be based on natural or synthetic oils, or blends thereof, provided the lubricant has a suitable viscosity for use in gear oil applications. Thus the base oils will normally have a viscosity in the range of SAE 50 to SAE 250, and more usually will range from SAE 70W to SAE 140. Suitable automotive gear oils also include cross-grades such as 75W-140, 80W-90, 85W-140, 85W-90, and the like. The base oils for such use are generally mineral oil base stocks such as for example conventional and solvent-refined paraffinic neutrals and bright stocks, hydrotreated paraffinic neutrals and bright stocks, naphthenic oils, cylinder oils, etc., including straight run and blended oils. Synthetic base stocks can also be used in the practice of this invention, such as for example poly-α-olefin oils (PAO), alkylated aromatics, polybutenes, diesters, polyol esters, polyglycols, polyphenyl ethers, etc., and blends thereof. Typical of such oils are blends of poly-alpha-olefins with synthetic diesters in weight proportions (PAO:ester) ranging from about 95:5 to about 50:50, typically about 75:25.

In forming the gear oils of this invention, the lubricant base stocks will usually contain components of (i) and (ii) in the following concentrations (weight percentages of active ingredients):

| Component | Preferred Range | More Preferred Range | Most Preferred Range |
|---|---|---|---|
| (i) | 0.01–5 | 0.1–2 | 0.4–0.6 |
| (ii) | 0.01–5 | 0.1–2 | 0.5–0.6 |

In formulating such gear oils composition components (i) and (ii) may be separately blended into the oil but preferably are blended into the oil concurrently in the form of an additive concentrate of this invention.

OTHER COMPONENTS

As noted above, the gear oils and gear oil additive concentrates with which components (i) and (ii) of this invention are employed have a sulfur additive complement, a phosphorus additive complement, and a nitrogen additive complement in proportions such that the composition possesses a weight ratio of sulfur to phosphorus in the range of about 5:1 to about 40:1 and a weight ratio of nitrogen to phosphorus in the range of about 0.05:1 to about 2:1, this nitrogen content being exclusive of the nitrogen introduced into the system by use of components (i) and (ii). An important consideration is that although any of a variety of sulfur, phosphorus, and nitrogen containing components may be utilized, they should not contain metallic components such as zinc, calcium, magnesium or the like as such components may interfere with the functioning of the overall composition in the big wheel-little wheel test. Accordingly the preferred sulfur-containing components which may be used include sulfurized olefins, alkyl polysulfides, sulfurized fatty oils, sulfur chloride treated fatty oils, sulfurized terpenes, and the like. The preferred phosphorus-containing additives which may be included in the compositions include monoalkyl phosphites and phosphates, dialkyl phosphites and phosphates, trialkyl phosphites and phosphates, monoaryl phosphites and phosphates, diaryl phosphites and phosphates, triaryl phosphites and phosphates, long chain phosphoric or phosphonic acids and esters, alkyl acid phosphates, alicyclic esters of phosphoric acids, and the like.

Typical nitrogen-containing additives for use in the compositions include substituted imidazolines, fatty amides, long chain amines, long chain imides, aromatic amines, amine salts of high molecular weight organic acids, alkylamines, polyacrylamides, triazole derivatives, and the like. Additional suitable additives are those containing at least two of the elements P, S and N in the same molecule, such as dithiophosphoric acid esters, phosphosulfurized terpenes, thiadiazoles, amine phosphates, olefin/phosphorus pentasulfide reaction products, and the like.

Other components which may be used in the gear oil formulations of this invention are well known to those skilled in the art. Nevertheless, brief discussions concerning a few such components are set forth below.

Extreme pressure and antiwear agents—Preferred additives of this type include the phosphorus-containing additives such as mixtures of alkyl phosphites and phosphates, sulfurized olefins, sulfurized esters, dihydrocarbyl polysulfides, and like materials. Typical chlorine-containing additives include chlorinated paraffin wax, trichlorothioacetals, tris(trichloroethyl)phosphate, reaction products between chlorine or chloride anion with compounds containing suitable functionality (such as olefins, carboxylic acids, alcohols, etc.), and like materials. Among boron additives which may used are boronated amines, boronated phosphines, boronated phosphites, and the like.

Defoamers—Illustrative materials of this type include silicone oils of suitable viscosity, glycerol monostearate, polyglycol palmitate, trialkyl monothiophosphates, esters of sulfonated ricinoleic acid, benzoylacetone, methyl salicylate, glycerol monooleate, glycerol dioleate, and the like. Defoamers are generally employed at concentrations of up to about 1% in the additive concentrate.

Demulsifiers—Typical additives which may be employed as demulsifiers in gear oils include alkyl benzene sulfonates, polyethylene oxides, polypropylene oxides, esters of oil soluble acids, and the like. Such additives are generally employed at concentration of up to about 3% in the additive concentrate.

Sulfur scavengers—This class of additives includes such materials as thiadiazoles, triazoles, and in general, compounds containing moieties reactive to free sulfur under elevated temperature conditions. See for example U.S. Pat. Nos. 3,663,561 and 4,097,387. Concentrations of up to about 3% in the concentrate are typical.

Antioxidants—Ordinarily, antioxidants that may be employed in gear oil formulations include phenolic compounds, amines, phosphites, and the like. Amounts of up to about 5% in the concentrate are generally sufficient.

Other commonly used additives or components include anti-rust agents or rust inhibitors, corrosion inhibitors, detergents, dyes, metal deactivators, pour point depressants, and diluents.

Examples 1–7 illustrate typical additive concentrates of this invention. In these examples, "pbw" represents parts by weight of the specific ingredient, which in the case of the succinimides, is the amount of active ingredient. Likewise, the boronated succinimides referred to in the examples are the products formed by reacting the particular succinimide with boric acid at a temperature of above 150° C. in quantity sufficient to yield a boron content in the product of at least 1% by weight.

EXAMPLE 1

| | |
|---|---|
| $C_{20}$, $C_{22}$, $C_{24}$ Alkenylsuccinimide* | 100 pbw |
| Boronated polyisobutenylsuccinimide** | 110 pbw |
| 100 Neutral Oil (19 centistokes at 40° C.) | 290 pbw |

*Formed from ammonia and alkenyl succinic anhydride produced from a mixture of olefins made by isomerizing a 1-olefin mixture containing 49% $C_{20}$, 42% $C_{22}$, and 8% $C_{24}$ 1-olefins.
**Formed from polyisobutenylsuccinic anhydride derived from polyisobutene with a number average molecular weight of about 1300 and polyethylene polyamines with an average composition of tetraethylene pentamine.

EXAMPLE 2

| | |
|---|---|
| $C_{18}$ Alkenylsuccinimide* | 120 pbw |
| Polyisobutenylsuccinimide** | 100 pbw |
| 100 Neutral Oil (19 centistokes at 40° C.) | 280 pbw |

*Formed from isomerized 1-octadecene
**Formed from polyisobutenylsuccinic anhydride derived from polyisobutene with a number average molecular weight of about 1300 and tetraethylenepentamine.

EXAMPLE 3

| | |
|---|---|
| Isomerized eicosenyl succinimide | 110 pbw |
| Boronated polyisobutenylsuccinimide* | 130 pbw |
| 100 Neutral Oil (19 centistokes at 40° C.) | 300 pbw |

*Formed from polyisobutenylsuccinic anhydride derived from polyisobutene with a number average molecular weight of about 1200 and polyethylene polyamines with an average composition of tetraethylene pentamine.

EXAMPLE 4

| | |
|---|---|
| Isomerized $C_{16}$, $C_{18}$, $C_{20}$ alkenylsuccinimide* | 125 pbw |
| Boronated polyisobutenylsuccinimide** | 130 pbw |
| 100 Neutral Oil (19 centistokes at 40° C.) | 270 pbw |

*Formed from an alkene mixture made by isomerizing a mixture containing 45% 1-hexadecene, 35% 1-octadecene, and 20% 1-eicosene.
**Formed from polyisobutenylsuccinic anhydride derived from polyisobutene with a number average molecular weight of about 1100 and polyethylene polyamines with an average composition of tetraethylene pentamine.

EXAMPLE 5

| | |
|---|---|
| Tricontenyl succinimide | 100 pbw |
| Polyisobutenylsuccinimide* | 120 pbw |
| 100 Neutral Oil (19 centistokes at 40° C.) | 310 pbw |

*Formed from polyisobutenylsuccinic anhydride derived from polyisobutene with a number average molecular weight of about 1300 and polyethylene polyamines with an average composition of tetraethylene pentamine.

EXAMPLE 6

| | |
|---|---|
| Polyisobutenylsuccinimide* | 100 pbw |
| Boronated polyisobutenylsuccinimide** | 100 pbw |
| 100 Neutral Oil (19 centistokes at 40° C.) | 330 pbw |

*Made from ammonia and polyisobutenylsuccinic anhydride formed from a polyisobutene having a number average molecular weight of 560.
**Formed from polyisobutenylsuccinic anhydride derived from polyisobutene with a number average molecular weight of about 1300 and tetraethylenepentamine.

EXAMPLE 7

| | |
|---|---|
| Polypropenylsuccinimide* | 120 pbw |
| Boronated polyisobutenylsuccinimide** | 130 pbw |
| 100 Neutral Oil (19 centistokes at 40° C.) | 300 pbw |

*Made from ammonia and polypropenylsuccinic anhydride formed from a polypropylene having a number average molecular weight of 500.
**Formed from polyisobutenylsuccinic anhydride derived from polyisobutene with a number average molecular weight of about 1200 and polyethylene polyamines with an average composition of tetraethylene pentamine.

Examples 8–14 illustrate finished gear oil additive concentrates within the contemplation of this invention. In each case, they are formed by blending an additive concentrate of this invention (or the individual components thereof) with a commercially available gear oil additive concentrate. In Examples 8–14, all parts are by weight.

EXAMPLE 8

With 69 parts of HITEC® 370 Additive (a product available from Ethyl Petroleum Additives, Inc.) is blended 31 parts of the concentrate of Example 1.

EXAMPLE 9

With 72 parts of HITEC® 375 Additive (a product available from Ethyl Petroleum Additives, Inc.) is blended 28 parts of the concentrate of Example 1.

EXAMPLE 10

With 68 parts of HITEC® 320 Additive (a product available from Ethyl Petroleum Additives, Inc.) is blended 32 parts of the concentrate of Example 1.

EXAMPLE 11

With 74 parts of Anglamol 6043B Additive (a product available from The Lubrizol Corporation) is blended 26 parts of the concentrate of Example 1.

EXAMPLE 12

With 80 parts of Anglamol 6043U Additive (a product available from The Lubrizol Corporation) is blended 20 parts of the concentrate of Example 1.

EXAMPLE 13

With 68 parts of Mobilad G 522 Additive (a product available from Mobil Chemical Company) is blended 32 parts of the concentrate of Example 1.

EXAMPLE 14

With 74 parts of Elco 7 Additive (a product available from Elco Corporation) is blended 26 parts of the concentrate of Example 1.

Examples 15–21 illustrate finished gear oils within the contemplation of this invention. In each case the resultant gear oil has a S:P weight ratio within the range of 5:1 to 40:1 and a weight ratio of N:P within the rang of 0.05:1 to 2:1 exclusive of the nitrogen added by way of the succinimide components used pursuant to this invention. Some of the base oils may contain pour point depressants to achieve the specified viscosity.

EXAMPLE 15

A finished gear oil additive concentrate formed as in Example 8 is blended with individual quantities of SAE 50 base oil, SAE 75W base oil, SAE 90 base oil, SAE 140 base oil, SAE 250 base oil, SAE 75W-140 base oil, 80W-90 base oil, 85W-140 base oil, and 85W-90 base oil.

In each case, the proportions employed are such that the nine resultant finished oils all contain 8.0% by weight of such gear oil additive concentrate. Alternatively, the same respective nine finished oils of this invention are formed by separately blending the corresponding proportions and amounts of the two components of Example 8 into the respective base oils.

EXAMPLE 16

A finished gear oil additive concentrate formed as in Example 9 is blended with individual quantities of SAE 50 base oil, SAE 75W base oil, SAE 90 base oil, SAE 140 base oil, SAE 250 base oil, SAE 75W-140 base oil, 80W-90 base oil, 85W-140 base oil, and 85W-90 base oil. In each case, the proportions employed are such that the nine resultant finished oils all contain 9.0% by weight of such gear oil additive concentrate. Alternatively, the same respective nine finished oils of this invention are formed by separately blending the corresponding proportions and amounts of the two components of Example 9 into the respective base oils.

EXAMPLE 17

A finished gear oil additive concentrate formed as in Example 10 is blended with individual quantities of SAE 50 base oil, SAE 75W base oil, SAE 90 base oil, SAE 140 base oil, SAE 250 base oil, SAE 75W-140 base oil, 80W-90 base oil, 85W-140 base oil, and 85W-90 base oil. In each case, the proportions employed are such that the nine resultant finished oils all contain 7.75% by weight of such gear oil additive concentrate. Alternatively, the same respective nine finished oils of this invention are formed by separately blending the corresponding proportions and amounts of the two components of Example 10 into the respective base oils.

EXAMPLE 18

A finished gear oil additive concentrate formed as in Example 11 is blended with individual quantities of SAE 50 base oil, SAE 75W base oil, SAE 90 base oil, SAE 140 base oil, SAE 250 base oil, SAE 75W-140 base oil, 80W-90 base oil, 85W-140 base oil, and 85W-90 base oil. In each case, the proportions employed are such that the nine resultant finished oils all contain 9.5% by weight of such gear oil additive concentrate. Alternatively, the same respective nine finished oils of this invention are formed by separately blending the corresponding proportions and amounts of the two components of Example 11 into the respective base oils.

EXAMPLE 19

A finished gear oil additive concentrate formed as in Example 12 is blended with individual quantities of SAE 50 base oil, SAE 75W base oil, SAE 90 base oil, SAE 140 base oil, SAE 250 base oil, SAE 75W-140 base oil, 80W-90 base oil, 85W-140 base oil, and 85W-90 base oil. In each case, the proportions employed are such that the nine resultant finished oils all contain 10.5% by weight of such gear oil additive concentrate. Alternatively, the same respective nine finished oils of this invention are formed by separately blending the corresponding proportions and amounts of the two components of Example 12 into the respective base oils.

EXAMPLE 20

A finished gear oil additive concentrate formed as in Example 13 is blended with individual quantities of SAE 50 base oil, SAE 75W base oil, SAE 90 base oil, SAE 140 base oil, SAE 250 base oil, SAE 75W-140 base oil, 80W-90 base oil, 85W-140 base oil, and 85W-90 base oil. In each case, the proportions employed are such that the nine resultant finished oils all contain 9.5% by weight of such gear oil additive concentrate. Alternatively, the same respective nine finished oils of this invention are formed by separately blending the corresponding proportions and amounts of the two components of Example 13 into the respective base oils.

EXAMPLE 21

A finished gear oil additive concentrate formed as in Example 14 is blended with individual quantities of SAE 50 base oil, SAE 75W base oil, SAE 90 base oil, SAE 140 base oil, SAE 250 base oil, SAE 75W-140 base oil, 80W-90 base oil, 85W-140 base oil, and 85W-90 base oil. In each case, the proportions employed are such that the nine resultant finished oils all contain 8.75% by weight of such gear oil additive concentrate. Alternatively, the same respective nine finished oils of this invention are formed by separately blending the corresponding proportions and amounts of the two components of Example 14 into the respective base oils.

The effectiveness of the compositions of this invention in alleviating the problem of noise and chatter in limited slip differentials was illustrated by tests conducted in accordance with the GM limited slip axle chatter test (R-4A1-4). In the version of the test employed, the vehicle used was a 1986 Buick Grand National having a 3.8 liter turbo-charged V-6 engine with single port fuel injection. The vehicle was equipped with an automatic transmission, power steering and brakes, and a clutch pack "plate" limited slip differential.

Prior to each test the rear axle was dissembled to allow replacement of the limited slip clutch packs, plates and springs. The entire assembly was washed with Stoddard solvent and air-dried to remove traces of any previous lubricant. The axle was assembled and lubricated with the test lubricant and a thermocouple was installed into the axle assembly to allow recording of lubricant temperature. The unit was bias checked, then run-in with equal size rear tires at 40 to 50 mph for fifty miles.

After the run-in, tires of different diameters were installed on the rear of the vehicle to obtain the specified differential rate between right and left wheel. The larger diameter tire being installed on the right rear position. At the recommendation of General Motors, E78×15 and L78×15 tires were used, resulting in approximately eight to nine revolutions per mile differential rate.

The test consisted of mileage accumulation at 55 to 60 mph with rear axle lubricant temperature between 280° F. and 300° F. The axle was insulated and the speed was varied slightly to maintain temperature within limits. Chatter checks were performed at approximately 100-mile intervals and torque bias checks were performed each thousand miles and at test completion.

The torque bias check consisted of placing one rear wheel on a low friction surface and a 2×4 block tightly in front of a front wheel. The vehicle was slowly accelerated to pull over the block. The low friction wheel should not spin freely.

The chatter check consisted of the car being driven through eight (8) figure "8" lock to lock turns at 5 to 8 mph. A thirty-second stop was made before each check and after completing each circle. Any chatter, roughness or unusual noise was noted.

Four such tests were conducted. In one test, a "passing" reference gear oil (a GM factory fill for limited slip differentials) was used. In a second test, a "failing" reference oil (a GL-5 non-limited slip gear lubricant) was used. The other two tests involve use of an SAE 80W-90 gear oil base stock containing in both cases 5.5% of a commercially available fully formulated gear oil additive containing 23% by weight of sulfur, 2.2% by weight of phosphorus, and 0.4% by weight of nitrogen. In one test this gear oil was used as is. In the other test, the additive concentrate of Example 1 was added as a "top treat" at a treat level of 2.5 weight percent based on the weight of the finished oil. The test results were as follows:

| Test No. | Composition | Results |
|---|---|---|
| 1 | "Passing" reference | Pass after 6000 miles |
| 2 | "Failing" reference | Fail after 1700 miles |
| 3 | Commercial Product | Fail after 2500 miles |
| 4 | Commercial Product + Top Treat | Pass after 6000 miles |

Without desiring to be bound or otherwise limited by theoretical considerations, a possible explanation for the excellent results achievable by the practice of this invention is that the ashless dispersant succinimide or succinic ester (component (ii)) keeps the critical mechanical surfaces clean so that the component (i) succinimide can interact with these metal surfaces and prevent or at least greatly minimize the extent to which noise and chatter may occur in limited slip differentials.

This invention is susceptible to considerable variation within the spirit and scope of the appended claims, the forms presented hereinabove constituting preferred embodiments thereof.

What is claimed is:

1. A gear oil additive composition comprising:

(i) at least one oil-soluble succinimide of the formula

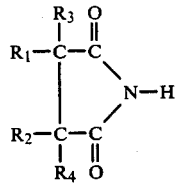

wherein $R_1$ is an alkyl or alkenyl group having an average of 8 to 50 carbon atoms, and each of $R_2$, $R_3$ and $R_4$ is, independently, a hydrogen atom or an alkyl or alkenyl group having an average of up to about 4 carbon atoms; and (ii) at least one boronated carboxylic derivative composition produced by reacting at least one substituted succinic acylating agent with a reactant selected from the group consisting of (a) amine having at least one primary or secondary amino group in the molecule, (b) at least one alcohol, and (c) a combination of (a) and (b), the components of (c) being reacted with such substituted succinic acylating agent(s) simultaneously or sequentially in any order, and reacting the resultant product with a boron compound to form said boronated carboxylic derivative composition, such substituted succinic acylating agent(s) having a substituent group derived from polyalkene having a number average molecular weight of about 500 to about 100,000;

said gear oil additive composition containing on a weight basis from 10 to 80% of component (i), and from 10 to 80% of component (ii), the total of (i) and (ii) being in the range of 20 to 90%;

said gear oil additive composition being devoid of any metal-containing additive component.

2. A composition as claimed in claim 1 wherein component (ii) is a boronated succinimide formed by reacting the substituted succinic acylating agent with alkylene polyamine and then reacting the resultant product with a boron compound to thereby form the boronated succinimide.

3. A composition as claimed in claim 1 wherein $R_1$ contains 14 to 30 carbon atoms and is represented by the formula $R_5R_6CH$— wherein $R_5$ and $R_6$ are, independently, alkyl or alkenyl groups.

4. A composition as claimed in claim 1 wherein $R_1$ contains an average of 20 to 24 carbon atoms, and wherein $R_3$ and $R_4$ are both hydrogen atoms.

5. A composition as claimed in claim 4 wherein $R_2$ is a hydrogen atom.

6. A composition as claimed in claim 1 wherein the proportions of (i):(ii) on a weight basis are in the range of from 2.5:1 to 1:2.5.

7. A composition as claimed in claim 1 wherein the proportions of (i):(ii) on a weight basis are in the range of from 1:1 to 1.2:1.

8. A composition as claimed in claim 1 further including a solvent oil.

9. A composition as claimed in claim 1 further including a solvent oil and wherein the additive composition contains on a weight basis from 10 to 50% of component (i), from 10–50% of component (ii), and 40–70% of solvent oil, the total of components (i) and (ii) being in the range of 30–60%.

10. A composition as claimed in claim 1 further including a solvent oil and wherein the additive composition contains on a weight basis from 10 to 35% of component (i), from 10–35% of component (ii), and 55–60% of solvent oil, the total of components (i) and (ii) being in the range of 40–45%.

11. A composition as claimed in claim 1 characterized in that it further includes a solvent oil, in that $R_1$ contains 14 to 30 carbon atoms and is represented by the formula $R_5R_6CH$— wherein $R_5$ and $R_6$ are alkyl or alkenyl groups, and in that component (ii) is a boronated succinimide formed by reacting the substituted succinic acylating agent with alkylene polyamine and then reacting the resultant product with a boron compound to thereby form the boronated succinimide.

12. A composition as claimed in claim 1 characterized in that it further includes a solvent oil, in that component (i) is predominantly a mixture of $C_{20}$, $C_{22}$, and $C_{24}$ sec-alkenylsuccinimides made from an isomerized 1-olefin mixture containing on a weight basis no more than 3% of $C_{18}$ alkene, 45–55% of $C_{20}$ alkene, 31–47% of $C_{22}$ alkene, 4–15% of $C_{24}$ alkene, and no more than 1% of $C_{26}$ alkene, and in that component (ii) is a boronated succinimide formed by reacting a polyisobutenyl substituted succinic acylating agent in which the polyisobutenyl substituent has a number average molecular weight in the range of 750 to 5,000 with alkylene polyamine represented by the formula $$H_2N(CH_2)_n(NH(CH_2)_n)_mNH_2$$

wherein n is in the range of 2 to 3 and m is in the range of 0 to 10, and then reacting the resultant product with a boron compound to thereby form the boronated succinimide.

13. A gear oil composition comprising a major amount of a gear oil base stock containing a sulfur additive complement, a phosphorus additive complement, and a nitrogen additive complement, in proportions such that the composition possesses a weight ratio of sulfur to phosphorus in the range of about 5:1 to about 40:1 and a weight ratio of nitrogen to phosphorus in the range of about 0.05:1 to about 2:1, said base oil additionally containing:

(i) from about 0.01 to about 5% by weight of at least one oil-soluble succinimide of the formula

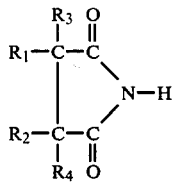

wherein $R_1$ is an alkyl or alkenyl group having an average of 8 to 50 carbon atoms, and each of $R_2$, $R_3$ and $R_4$ is, independently, a hydrogen atom or an alkyl or alkenyl group having an average of up to about 4 carbon atoms; and (ii) from about 0.01 to about 5% by weight of at least one boronated carboxylic derivative composition produced from at least one substituted succinic acylating agent and a reactant selected from the group consisting of (a) amine having at least one primary or secondary amino group in the molecule, (b) at least one alcohol, and (c) a combination of (a) and (b), the components of (c) being reacted with such substituted succinic acylating agent(s) simultaneously or sequentially in any order, wherein such substituted succinic acylating agent(s) has/have a substituent group derived from polyalkene having a number average molecular weight of about 500 to about 100,000;

said gear oil composition being devoid of any metal-containing additive component.

14. A composition as claimed in claim 13 wherein component (ii) is a boronated succinimide formed by reacting the substituted succinic acylating agent with alkylene polyamine and then reacting the resultant product with a boron compound to thereby form the boronated succinimide.

15. A composition as claimed in claim 13 wherein $R_1$ contains 14 to 30 carbon atoms and is represented by the formula $R_5R_6CH$— wherein $R_5$ and $R_6$ are, independently, alkyl or alkenyl groups.

16. A composition as claimed in claim 13 wherein $R_1$ contains an average of 20 to 24 carbon atoms, and wherein $R_3$ and $R_4$ are both hydrogen atoms.

17. A composition as claimed in claim 16 wherein $R_2$ is a hydrogen atom.

18. A composition as claimed in claim 13 wherein the proportions of (i):(ii) on a weight basis are in the range of from 2.5:1 to 1:2.5.

19. A composition as claimed in claim 13 wherein the proportions of (i):(ii) on a weight basis are in the range of from 1:1 to 1.2:1.

20. A composition as claimed in claim 13 characterized in that $R_1$ contains 14 to 30 carbon atoms and is represented by the formula $R_5R_6CH$— wherein $R_5$ and $R_6$ are alkyl or alkenyl groups, and in that component (ii) is a boronated succinimide formed by reacting the substituted succinic acylating agent with alkylene polyamine and reacting the resultant product with a boron compound to form the boronated succinimide.

21. A composition as claimed in claim 13 characterized in that component (i) is predominantly a mixture of $C_{20}$, $C_{22}$, and $C_{24}$ sec-alkenylsuccinimides made from an isomerized 1-olefin mixture containing on a weight basis no more than 3% of $C_{18}$ alkene, 45–55% of $C_{20}$ alkene, 31–47% of $C_{22}$ alkene, 4–15% of $C_{24}$ alkene, and no more than 1% of $C_{26}$ alkene, and in that component (ii) is a boronated succinimide formed by reacting an polyisobutenyl succinic anhydride in which the polyisobutene substituent has a number average molecular weight in the range of 750 to 5,000 with alkylene polyamine represented by the formula $$H_2N(CH_2)_n(NH(CH_2)_n)_mNH_2$$

wherein n is in the range of 2 to 3 and m is in the range of 0 to 10, and then reacting the resultant product with a boron compound to form said boronated succinimide.

22. A gear oil additive composition comprising:

(i) at least one oil-soluble succinimide of the formula

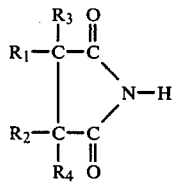

wherein $R_1$ is an alkyl or alkenyl group having an average of 8 to 50 carbon atoms, and each of $R_2$, $R_3$ and $R_4$ is, independently, a hydrogen atom or an alkyl or alkenyl group having an average of up to about 4 carbon atoms;

(ii) at least one boronated carboxylic derivative composition produced by reacting at least one substituted succinic acylating agent with a reactant selected from the group consisting of (a) amine having at least one primary or secondary amino group in the molecule, (b) at least one alcohol, and (c) a combination of (a) and (b), the components of (c) being reacted with such substituted succinic acylating agent(s) simultaneously or sequentially in any order, wherein such substituted succinic acylating agent(s) has/have a substituent group derived from polyalkene having a number average molecular weight of about 700 to about 5,000; and

(iii) diluent oil;

said gear oil additive composition containing on a weight basis from 10 to 80% of component (i), from 10 to 80% of component (ii), and from 10 to 80% of component (iii), the total of (i) and (ii) being in the range of 20 to 90%;

said gear oil additive composition being devoid of any metal-containing additive component.

23. A composition as claimed in claim 22 wherein said reactant (a) is at least one alkylene polyamine, said reactant (b) is at least one polyhydric alcohol, and said reactant (c) is a combination of at least one alkylene polyamine and at least one polyhydric alcohol.

24. A composition as claimed in claim 22 wherein $R_1$ contains 14 to 30 carbon atoms and is represented by the formula $R_5R_6CH$— wherein $R_5$ and $R_6$ are, independently, alkyl or alkenyl groups; and wherein said reactant (a) is at least one alkylene polyamine, said reactant (b) is at least one polyhydric alcohol, and said reactant (c) is a combination of at least one alkylene polyamine and at least one polyhydric alcohol.

25. A composition as claimed in claim 22 wherein $R_1$ contains an average of 20 to 24 carbon atoms, and wherein $R_3$ and $R_4$ are both hydrogen atoms; and wherein said reactant (a) is at least one alkylene polyamine, said reactant (b) is at least one polyhydric alcohol, and said reactant (c) is a combination of at least one alkylene polyamine and at least one polyhydric alcohol.

26. A composition as claimed in claim 22 wherein $R_1$ contains an average of 20 to 24 carbon atoms, and wherein $R_2$, $R_3$ and $R_4$ are hydrogen atoms; and wherein said reactant (a) is at least one alkylene polyamine, said reactant (b) is at least one polyhydric alcohol, and said reactant (c) is a combination of at least one alkylene polyamine and at least one polyhydric alcohol.

27. A composition as claimed in claim 22 wherein the proportions of (i):(ii) on a weight basis are in the range of from 2.5:1 to 1:2.5.

28. A composition as claimed in claim 22 wherein the proportions of (i):(ii) on a weight basis are in the range of from 1:1 to 1.2:1.

29. A composition as claimed in claim 22 characterized in that component (i) is predominantly a mixture of $C_{20}$, $C_{22}$, and $C_{24}$ sec-alkenylsuccinimides made from an isomerized 1-olefin mixture containing on a weight basis no more than 3% of $C_{18}$ alkene, 45–55% of $_{20}$ alkene, 31–47% of $C_{22}$ alkene, 4–15% of $C_{24}$ alkene, and no more than 1% of $C_{26}$ alkene, and in that component (ii) is a boronated polyisobutenyl succinimide.

30. A composition as claimed in claim 22 further comprising an additive complement selected from (1) sulfur-containing additives, (2) phosphorus-containing additives, and (3) nitrogen-containing additives such that said composition possesses a weight ratio of sulfur to phosphorus in the range of about 5:1 to about 40:1 and a weight ratio of nitrogen to phosphorus in the range of about 0.05:1 to about 2:1, this nitrogen content being exclusive of the nitrogen of components (i) and (ii).

31. A composition as claimed in claim 30 wherein the proportions of (i):(ii) on a weight basis are in the range of from 2.5:1 to 1:2.5.

32. A composition as claimed in claim 30 wherein the proportions of (i):(ii) on a weight basis are in the range of from 1:1 to 1.2:1.

33. A composition as claimed in claim 30 characterized in that component (i) is predominantly a mixture of $C_{20}$, $C_{22}$, and $C_{24}$ sec-alkenylsuccinimides made from an isomerized 1-olefin mixture containing on a weight basis no more than 3% of $C_{18}$ alkene, 45–55% of $C_{20}$ alkene, 31–47% of $C_{22}$ alkene, 4–15% of $C_{24}$ alkene, and no more than 1% of $C_{26}$ alkene, and in that component (ii) is a boronated polyisobutenyl succinimide of at least one polyalkylene polyamine.

34. A gear oil composition comprising a major amount of a gear oil base stock containing a sulfur additive complement, a phosphorus additive complement, and a nitrogen additive complement, in proportions such that the composition possesses a weight ratio of sulfur to phosphorus in the range of about 5:1 to about 40:1 and a weight ratio of nitrogen to phosphorus in the range of about 0.05:1 to about 2:1, said base oil additionally containing:

(i) from about 0.01 to about 5% by weight of at least one oil-soluble succinimide of the formula

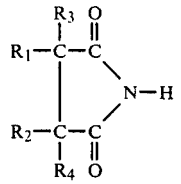

wherein $R_1$ is an alkyl or alkenyl group having an average of 8 to 50 carbon atoms, and each of $R_2$, $R_3$ and $R_4$ is, independently, a hydrogen atom or an alkyl or alkenyl group having an average of up to about 4 carbon atoms; and (ii) from about 0.01 to about 5% by weight of at least one boronated carboxylic derivative composition produced by reacting at least one substituted succinic acylating agent with a reactant selected from the group consisting of (a) amine having at least one primary or secondary amino group in the molecule, (b) at least one alcohol, and (c) a combination of (a) and (b), the components of (c) being reacted with such substituted succinic acylating agent(s) simultaneously or sequentially in any order, and reacting the resultant product with a boron compound to form said boronated carboxylic derivative composition, such substituted succinic acylating agent(s) having a substituent group derived from polyalkene having a number average molecular weight of about 700 to about 5,000;

said gear oil composition being devoid of any metal-containing additive component.

35. A composition as claimed in claim 34 wherein said reactant (a) is at least one alkylene polyamine, said reactant (b) is at least one polyhydric alcohol, and said reactant (c) is a combination of at least one alkylene polyamine and at least one polyhydric alcohol.

36. A composition as claimed in claim 34 wherein $R_1$ contains 14 to 30 carbon atoms and is represented by the formula $R_5R_6CH$— wherein $R_5$ and $R_6$ are, independently, alkyl or alkenyl groups; and wherein said reactant (a) is at least one alkylene polyamine, said reactant (b) is at least one polyhydric alcohol, and said reactant (c) is a combination of at least one alkylene polyamine and at least one polyhydric alcohol.

37. A composition as claimed in claim 34 wherein $R_1$ contains an average of 20 to 24 carbon atoms, and wherein $R_2$, $R_3$ and $R_4$ are hydrogen atoms; and wherein said reactant (a) is at least one alkylene polyamine, said reactant (b) is at least one polyhydric alcohol, and said reactant (c) is a combination of at least one alkylene polyamine and at least one polyhydric alcohol.

38. A composition as claimed in claim 34 wherein the polyalkene used in forming said substituted acylating agent is polyisobutene.

39. A composition as claimed in claim 34 wherein the proportions of (i):(ii) on a weight basis are in the range of from 2.5:1 to 1:2.5.

40. A composition as claimed in claim 34 wherein the proportions of (i):(ii) on a weight basis are in the range of from 1:1 to 1.2:1.

41. A composition as claimed in claim 34 characterized in that component (i) is predominantly a mixture of $C_{20}$, $C_{22}$, and $C_{24}$ sec-alkenylsuccinimides made from an isomerized 1-olefin mixture containing on a weight basis no more than 3% of $C_{18}$ alkene, 45–55% of $_{20}$ alkene, 31–47% of $C_{22}$ alkene, 4–15% of $C_{24}$ alkene, and no more than 1% of $C_{26}$ alkene, and in that component (ii) is a boronated polyisobutenyl succinimide.

42. A composition as claimed in claim 34 wherein said composition contains from about 0.1 to about 2% by weight of component (i) and from about 0.1 to about 2% by weight of component (ii).

43. A composition as claimed in claim 34 wherein said composition contains from about 0.4 to about 0.6% by weight of component (i) and from about 0.5 to about 0.6% by weight of component (ii).

44. A gear oil composition comprising a base oil having a viscosity in the range of SAE 50 to SAE 250 containing (i) from about 0.01 to about 5% by weight of at least one oil-soluble succinimide of the formula

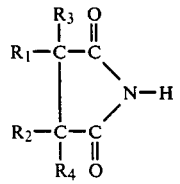

wherein $R_1$ is an alkyl or alkenyl group having an average of 8 to 50 carbon atoms, and each of $R_2$, $R_3$ and $R_4$ is, independently, a hydrogen atom or an alkyl or alkenyl group having an average of up to about 4 carbon atoms; and (ii) from about 0.01 to about 5% by weight of at least one boronated carboxylic derivative composition produced by reacting at least one substituted succinic acylating agent with a reactant selected from the group consisting of (a) amine having at least one primary or secondary amino group in the molecule, (b) at least one alcohol, and (c) a combination of (a) and (b), the components of (c) being reacted with such substituted succinic acylating agent(s) simultaneously or sequentially in any order, and reacting the resultant product with a boron compound to form said boronated carboxylic derivative composition, such substituted succinic acylating agent(s) having a substituent group derived from polyalkene having a number average molecular weight of about 700 to about 5,000;

said gear oil composition being devoid of any metal-containing additive component.

45. A composition as claimed in claim 44 wherein said viscosity is in the range of from SAE 70W to SAE 140.

* * * * *